US006057643A

United States Patent [19]

Kurai

[11] Patent Number: 6,057,643

[45] Date of Patent: May 2, 2000

[54] DISCHARGE GAS MIXTURE FOR A FLUORESCENT GAS-DISCHARGE PLASMA DISPLAY PANEL

[75] Inventor: Teruo Kurai, Amagasaki, Japan

[73] Assignee: Fujitsu Limited, Kawasaki, Japan

[21] Appl. No.: 09/012,546

[22] Filed: Jan. 23, 1998

[30] Foreign Application Priority Data

Jun. 30, 1997 [JP] Japan ..... 9-173692

[51] Int. Cl.[7] ..... H01J 17/20

[52] U.S. Cl. ..... 313/582; 313/643

[58] Field of Search ..... 313/582, 584, 313/585, 643, 637

[56] References Cited

U.S. PATENT DOCUMENTS

| | | | |
|---|---|---|---|
| 3,904,915 | 9/1975 | Hinson | 313/643 |
| 4,926,095 | 5/1990 | Shinoda et al. | 315/169.4 |
| 5,559,403 | 9/1996 | Sakai et al. | 313/637 |

*Primary Examiner*—Nimeshkumar D. Patel
*Attorney, Agent, or Firm*—Staas & Halsey

[57] ABSTRACT

A plasma display panel including a pair of substrates comprises a mixture of discharge gases contained between the substrates; the mixture consists of neon gas, xenon gas and krypton gas, wherein a percentage content of the krypton gas is selected in the range from 1 to 14 percent of the mixture, whereby near-infrared rays radiated from the xenon gas during the gas discharge is retarded while the operational margin of the AC driving voltage is preferably maintained.

11 Claims, 3 Drawing Sheets

DISCHARGE GAS MIXTURE FOR A FLUORESCENT GAS-DISCHARGE PLASMA DISPLAY PANEL

BACKGROUND OF THE INVENTION

1. Field of the Invention

This invention relates to a plasma display panel, referred to hereinafter as a PDP.

2. Description of the Related Arts

PDPs have been extensively employed for monitors of television receivers and computers, and the structures as well as the materials thereof are still further under improvements.

AC type PDPs of three-electrode structure are commercially on production for color display devices. This structure is such that a pair of sustain electrodes is arranged for each line of the display matrix, and an address electrode is arranged for each row of the matrix. Colors to be displayed are determined by controlling the amount of light emitted from respective fluorescent materials of R (Red), G (Green) and B (Blue).

In this kind of PDP is employed as a discharge gas a Penning gas in which a small amount of xenon (Xe) gas is mixed with neon gas (Ne). Upon generating a discharge between a pair of sustain electrodes in pair the discharge gas emits an ultra violet ray. The fluorescent material is excited by this ultra violet lay so as to emit its light. The mixing ratio in the discharge gas is optimized in consideration of the margin of driving voltages, the deterioration of the fluorescent materials and the dielectric protection layer caused by bombardment thereto. The mixing ratio is typically 2 to 10 percent.

As a prior art, it has been known that a helium (He) gas is added into the above-described Penning gas (Ne+Xe). The addition of the helium gas improves the luminous efficiency as well as the color purity.

The increase in the xenon gas content decreases the excited light emission from the neon gas so as to relatively increase light emission of the fluorescent material, resulting in an improvement of the display color purity. On the contrary, the discharge firing voltage increases considerably; therefore, it is impossible to expect a distinct improvement in the color purity within the practical range of driving voltages. Moreover, the xenon gas emitting a near-infrared ray together with the ultra violet ray causes a problem in that the increase of the xenon gas enhances a possibility of disturbing an infrared remote controller of electric appliances or an infrared communication equipment located near the PDP.

On the other hand, there is another problem in that though the addition of helium gas improves the light emitting efficiency as well as the color purity as described above, the further addition thereof accelerates the sputtering of the fluorescent materials and the protection layer, resulting in a short operation life of the PDP. Furthermore, these is a problem of helium lessening the voltage margin of the AC driving voltages. Still more, the effect of xenon gas to suppress the near infrared ray is small, but the addition of helium gas adequate to suppress the near infrared ray considerably shortens the operation life, and the less operating margin makes the driving difficult.

SUMMARY OF THE INVENTION

It is a general object of the invention to provide a PDP that allows a decrease in the relative strength of the visual lights emitted from the neon gas so as to improve the color impurity, together with a decrease in the near-infrared light emitted from Xe gas.

It is another object of the present invention to enhance the operation margin in the AC driving voltage.

The plasma display panel according to the present invention including a pair of substrates comprises a mixture of discharge gases contained between the substrates; the mixture consists of neon gas, xenon gas and krypton gas, wherein a percentage content of the krypton gas is selected in the range of from 1 to 14 percent of the mixture, so that near-infrared rays radiated from the xenon gas during a gas discharge are retarded.

The above-mentioned features and advantages of the present invention, together with other objects and advantages, which will become apparent, will be more fully described hereinafter, with references being made to the accompanying drawings which form a part hereof, wherein like numerals refer to like parts throughout.

DESCRIPTION OF THE PREFERRED EMBODIMENT

Figure 1:
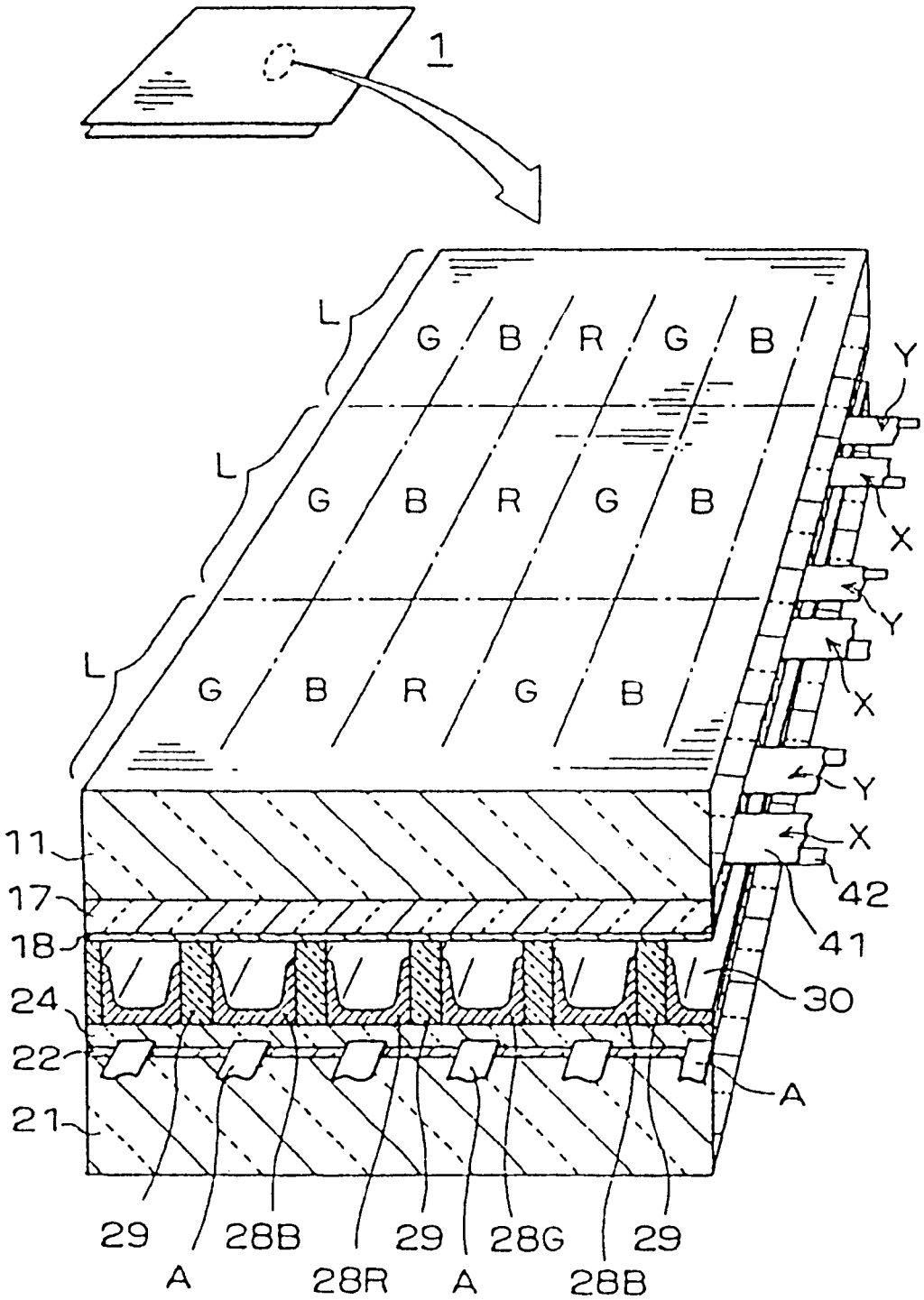
FIG. 1 schematically illustrates a perspective view of an internal structure of a PDP related to the present invention.

Hereinafter is described a first preferred embodiment of the present invention, with reference to FIG. 1 illustrating an internal structure of a PDP 1 in which the present invention is embodied.

PDP 1 is a surface discharge type PDP of AC drive provided with sustain electrodes X and Y arranged in parallel in pairs, having an electrode matrix of three-electrode structure wherein sustain electrodes X & Y and an address electrode A correspond to each single cell. Sustain electrodes X & Y extend along a line direction, i.e. the horizontal direction. A first sustain electrode Y in the pair is used as a scan electrode for selecting cells, by each line, in an addressing operation. An address electrode A extends along a row direction, i.e. a vertical direction, for selecting cells by each row, and may also be called a data electrode.

Sustain electrodes X & Y are disposed upon an inner surface of a front glass substrate 11 of a pair facing each other so that a pair of the sustain electrodes X & Y form a line L which is an array of the cells in horizontal direction of the screen.

Sustain electrodes X & Y are respectively formed with a transparent electrode 41 and a metal film 42 for decreasing the electrical resistance, and are coated with a dielectric layer 17 for the AC driving. The material of dielectric layer 17 is formed of a low melting-temperature glass including PbO (lead oxide) having a dielectric constant of approximately 10. Upon the surface of dielectric layer 17 is coated a protection layer 18 having a large secondary electron emission coefficient typically formed of MgO (magnesium oxide) film. Dielectric layer 17 and MgO film 18 are transparent. Upon an inner surface of a back substrate 21 are provided an under coat layer 22, address electrodes A, an insulating layer 24, separating walls 29 and fluorescent material layers 28R, 28G and 28B, for displaying three colors, red, green and blue (R, G, B), respectively. Each separating wall is straight when viewed from the top side. Separating walls 29 divide discharge space 30 into each sub pixel (unit light emitting areas) along the line direction, and keep the gaps, i.e. the heights, of the discharge space 30 uniform, typically approximately 150 $\mu$m. Discharge spaces 30 is filled with a discharge gas particular to the present invention, that is, a mixture of neon, xenon and krypton gases according to the ratios described latter. Gas pressure therein is approximately 500 Torr. Fluorescent material layers 28R, 28G and 28B are formed by printing pastes the fluorescent materials typically disclosed in Table 1, and then being baked, so that predetermined visible lights can be emitted, respectively.

TABLE 1

| EMITING COLOR | FLUORESCENT MATERIAL |
|---|---|
| R | $(Y, Gd)BO_3:E^{3+}$ |
| G | $Zn_2SiO_4:Mn$ |
| B | $3(Ba, Mg)O.8Al_2O_3:Eu^{2+}$ |

15 A single pixel of the display is formed of three cells aligning along the line direction. Structural elements in each sub pixel form the cell. Because the layout pattern of separating walls is of a stripe pattern, discharge space 30 corresponding to each row is continuous along the row direction crossing over all the lines. The emitting color of sub pixels in each row is identical.

PDP 1 described above is fabricated according to the sequence of the steps such that upon glass substrates 11 & 12 are fabricated respective predetermined structural elements so as to make the front and back substrate assemblies; the front and back substrate assemblies are stacked and peripheral portion thereof are sealed with each other, the gas sealed therein is exhausted, and the discharge gas is filled thereinto. The PDP 1 is then connected to a driving unit which is not shown in the figures, so as to be employed as a display device of television receiver hung on a wall, a monitor of computer system, etc.

In displaying with PDP 1, a display period allocated to a single frame is divided into a reset period for equalizing wall charges of the entire screen in order to prevent effects of the previous lighting state, an addressing period for addressing, i.e. setting the lighting/non-lighting, each cell in accordance with the data contents to be displayed, and a sustain period for sustaining the lighting state so as to secure the brightness of the required gradation level.

During the reset period, a reset pulse whose peak value exceeds the breakdown voltage of the surface discharge is applied to selected sustain electrodes, typically the respective sustain electrodes X of all the lines, while the other sustain electrodes, Y, are kept on the ground level. Upon the rise of the reset pulse there are generated strong surface discharges between the respective pairs of sustain electrodes X & Y of all the lines, resulting in the generation of wall charges in a great quantity in the cells. The effective cell voltage in each is lowered by offsetting the wall voltage therein with the applied voltage. Upon the fall of the reset pulse, the wall voltage itself becomes the effective voltage and causes a self-discharge so as to discharge almost all the wall charges in all the cells, whereby the entire screen becomes is in a uniformly non-charged state.

During the address period, one of the lines is selected sequentially from a side of the arrayed lines by applying a scan pulse onto the corresponding sustain electrode Y. Concurrently with the selection of the line, an address pulse is applied to the address electrode A which corresponds to the cells to be lit. In the cells applied with the address pulse on the selected line is generated an opposing discharge between the sustain electrode Y and an address electrode A, and then shifts to a surface discharge. This sequence of the discharges is the address discharge. Thus, the address discharge forms the charged state only in the cells to be lit.

During the sustain period, sustain pulses are applied alternately to sustain electrodes X and sustain electrodes Y. The peak value of the sustain pulses is lower than the surface discharge breakdown voltage. Upon each application of the sustain pulses the surface discharge takes place only in the cells in which the charged state has been formed. Application cycle of the sustain pulses is constant. There are applied sustain pulses of the quantity preset according to the weight of brightness. During the surface discharge the fluorescent materials are excited by the ultra violet ray emitted from the xenon gas in the discharge gas, so as to emit the color R, G or B, respectively. The displayed color is determined by the ratio of brightness of each cell of R, G and B of a single pixel.

Figure 2:
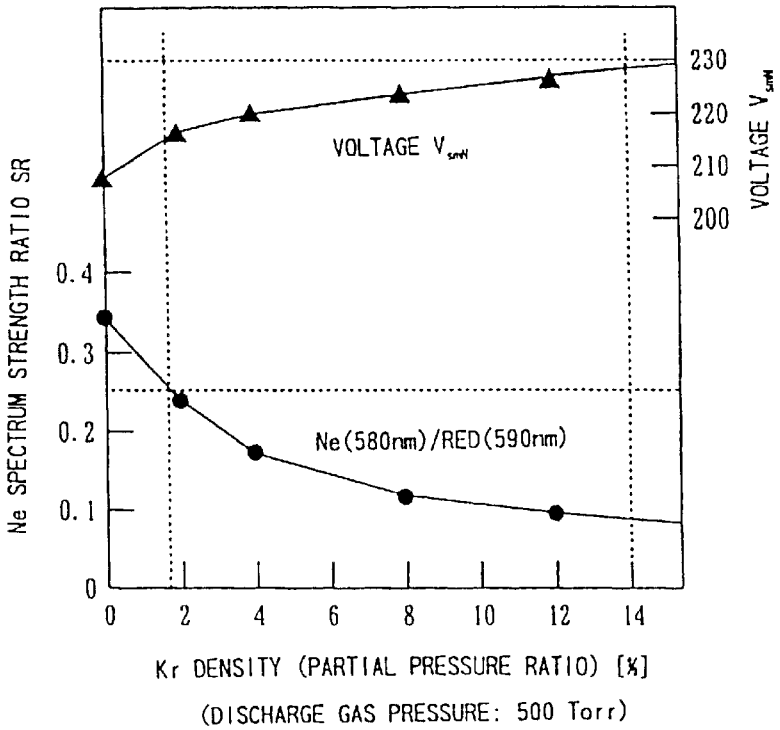
FIG. 2 shows a relation between krypton (Kr) density and display characteristics.
Figure 3:
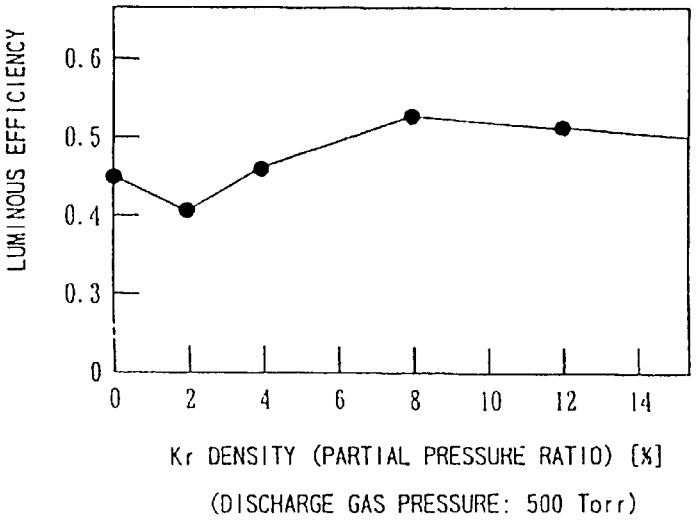
FIG. 3 shows a relation between krypton (Kr) density and luminous efficiency.

Hereinafter is described the contents of the discharge gas. FIG. 2 is a graph to show the relation between the density of krypton gas and the display characteristics. FIG. 3 is a graph to show the relation between the density of krypton gas and the light emitting characteristics.

Neon spectrum ratio SR=S580/S590 of a visible light strength S580 of 580 nm wavelength emitted from neon gas to another visible light strength S590 of 590 nm wavelength of red light zone emitted from the red fluorescent material layer 28R were measured while the xenon gas component was fixed at 4% in the discharge gas measured by the partial pressure, then the krypton gas component was varied, where the remainder was the neon gas. In order to evaluate the disturbance of neon light to the visible display lights, the spectrum S590 was chosen as representative of the display of visible lights.

With 0% krypton gas content, in other words 96% neon gas +4% xenon gas measured by partial pressure, the spectrum ratio SR was 0.33. On this sample, when the sustain voltage was gradually lowered from the static display state where all the cells are lit to the minimum sustain voltage for the first extinction of a lit cell $V_{smN}$, the sustain pulse measured by the peak value was 208 V. The minimum sustain voltage for the first extinction of a lit cell $V_{smN}$ corresponds to the lower limit $V_{smin}$ of the margin of the sustain voltage in the dynamic display of practical use.

The discharge gas was exhausted once from the above sample PDP, a second discharge gas was filled again therein so as to make a second sample PDP including 2% krypton component, that is 94% Ne+4% Xe+2% Kr measured by the partial pressure. In the second sample PDP, the neon spectrum strength ratio SR was 0.24. In the same way, the further increase in the krypton content provides the less neon spectrum strength ratio SR as indicated with black dots ● in FIG. 2. This means that the unnecessary visible light spectrum strength S580 emitted from the neon gas was relatively lowered so that the ultraviolet ray strength to excite the fluorescent material is relatively increased resulting in an enhancement of the purity of the color to be displayed. However, the minimum sustain voltage for the first extinction $V_{smN}$ tends to increase as the krypton density is increased as indicated with black triangles ▲ in FIG. 2. As seen in FIG. 2, when the Kr component is more than approximately 1%, the color purity represented by the spectrum strength ratio SR is improved by more than 30%. On the other hand, the upper limit of the sustain voltage is approximately 230 V due to the restriction caused from the practical circuit. In order to achieve a stable display using a sustain voltage lower than 230 V the krypton density has to be less than 14%. In other words, the krypton density range to accomplish the object of the present invention is 1 to 14%; and the more preferable range in consideration of the difference in the light emission efficiency 8±2%, that is 6 to 10%. Though the effect of adding the krypton varies somewhat according to the xenon density, at the practical range of the xenon density of from 1 to 10% the appropriate range of the krypton density is approximately those values described above.

The increase in the above-mentioned minimum sustain voltage for first extinction $V_{smN}$ can be controlled by the employment of a mixture of an alkaline earth metal compound, that is typically strontium oxide, magnesium oxide or calcium oxide, for the protection layer, as disclosed in detail in U.S. Pat. No. 4,198,585.

A mere increase in the xenon density decreases the spectrum strength ratio SR as described in the PRIOR ART of the present specification. However, the increase in the minimum sustain voltage $V_{smN}$ caused thereby is much more than the increase in the case where the krypton density is increased. Accordingly, it is impossible to expect the considerable improvement in the color purity by means of increasing the xenon density.

Figure 4:
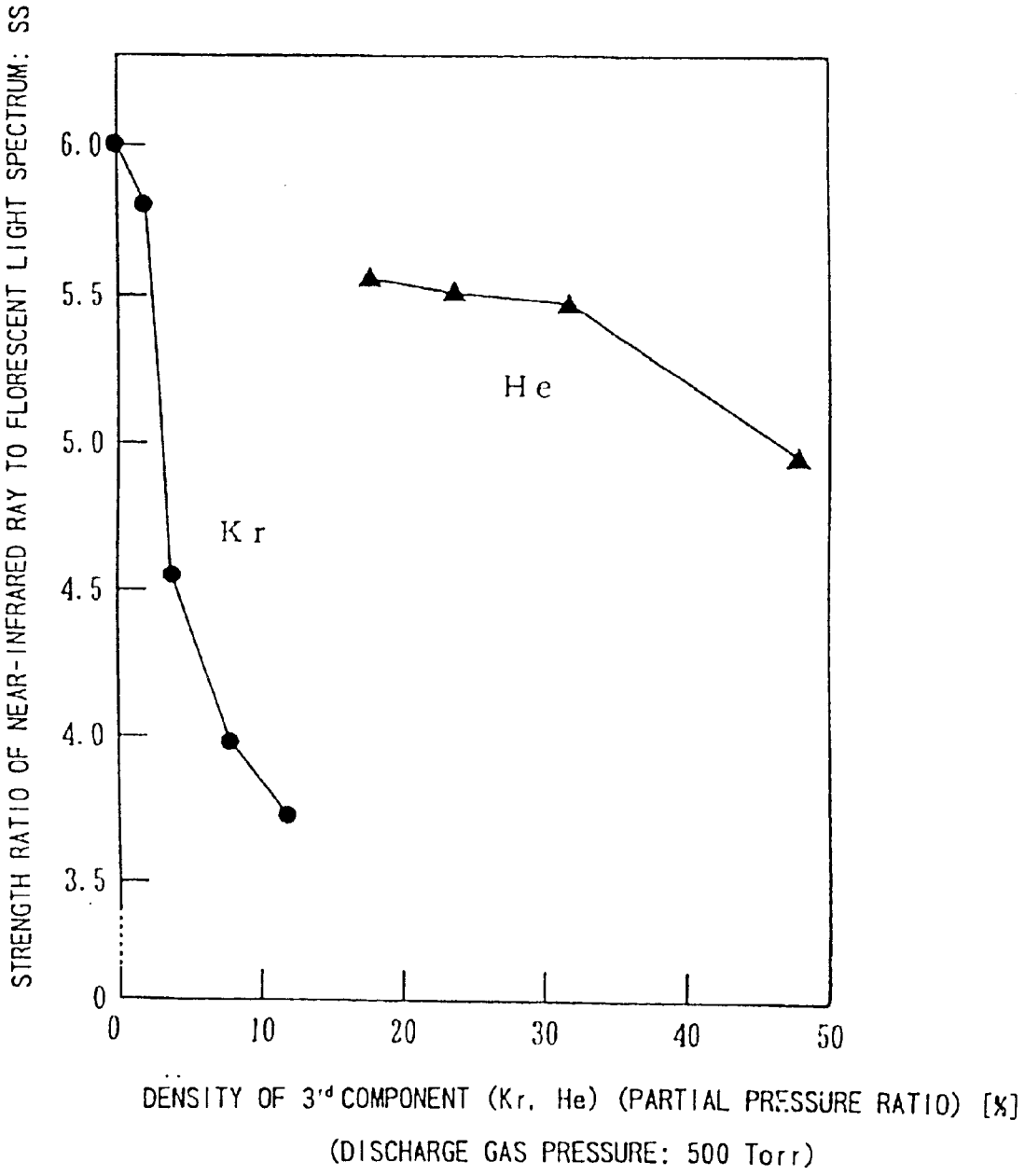
FIG. 4 shows a relation between the a third component density and a near-infrared ray suppression effect.

FIG. 4 is a graph showing the relation between the density of the third component Kr or He in Ne+Xe and the effect to suppress the near-infrared ray. There was investigated a ratio SS of the sum $S_{IR}$ of spectrum strengths of the near-infrared rays having wavelengths 820 nm, 880 nm and 980 nm, each radiated from the xenon gas to the strength S590 of the above-mentioned light in the red zone emitted from the fluorescent material, that is the ratio $SS=S_{IR}/S590$. The investigation was carried out by the use of two independent samples A and B each having the identical structure, however respectively filled with krypton gas and helium gas, so that the krypton gas and the helium gas are never mixed with each other.

As seen in FIG. 4, with the increase of krypton density the near-infrared spectrum strength ratio SS radiated from the xenon gas is drastically decreased. Thus, the radiation which will disturb infrared remote controller used for TV, etc. is suppressed. On the contrary, even though the helium gas added as the third component can decrease the infrared spectrum with the increase of its density, the degree is a little.

Helium has a smaller collision cross-section than neon. Accordingly, by the increase in the helium component, the amount of kinetic energy loss caused from the collision of ions in the discharge space decreases whereby sputtering of fluorescent material 28R, 28R and 28B and MgO film 18 is accelerated, resulting in shortening operation life of the PDP. On the contrary, krypton, since having a larger collision cross-section than neon, can suppress sputtering. Thus, krypton gas can contribute to the suppression of the near-infrared radiation and the enhancement of the operation life of the panel.

Moreover, as seen in TABLEs 2 and 3, the addition of krypton gas can improve the luminous efficiency to the same degree as the addition of helium gas, while the required operational voltage margin can be maintained. The figures in TABLEs 2 and 3 are those measured with the panels having the best luminous efficiency. The voltage $V_{fl}$ indicates a minimum sustain voltage for first lighting a cell when the sustain voltage is gradually increased after the addressing operation is performed for the entire-cell lighting, and corresponds to the upper limit $V_{smax}$ of the sustain voltage margin. The difference between the minimum sustain voltage $V_{fl}$ for first lighting a cell and the above-mentioned minimum sustain voltage for first extinguishing the light $V_{smN}$ is the operational voltage margin. The addition of helium gas decreased the voltage margin from 15 V to 3 V. The addition of krypton gas increased the voltage margin from 0 V to 15 V.

TABLE 2

| 3rd comp. | Brightness cd/m$^2$ | Sustain Volt. | Chroma X | (white) Y | Lumin' Effic. lm/W |
|---|---|---|---|---|---|
| None | 81.6 | 200 V | 0.338 | 0.346 | 0.4686 |
| He (18%) | 99.2 | 210 | 0.312 | 0.331 | 0.5516 |
| Kr (8%) | 112.0 | 230 | 0.316 | 0.326 | 0.5432 |

TABLE 3

| Panel | 3rd Component | $V_{smN}$ | $V_{f1}$ | Voltage Margin |
|---|---|---|---|---|
| A | None | 198 V | 213 V | 15 V |
| A | He(18%) | 206 | 209 | 3 |
| B | None | 208 | 208 | 0 |
| B | Kr(8%) | 224 | 239 | 15 |

33 As described above, according to the present invention, the addition of krypton gas into a mixture of neon gas and xenon gas enhances the luminous efficiency, improves the color purity and suppresses the near-infrared ray radiation while the voltage margin of the driving pulses are maintained.

Though in the above description of the preferred embodiment was typically referred to an AC type surface discharge PDP 1, it is apparent that the present invention can be applied to a DC type surface discharge PDP, and an AC or DC type opposing discharge PDP. Furthermore, the present invention can be applied to aplasma addressed liquid crystal, usually referred to as a PALC.

The may features and advantages of the invention are apparent from the detailed and thus, it is intended by the appended claims to cover all such features and advantages of the methods which fall within the true spirit and scope of the invention. Further, since numerous modifications and changes will readily occur to those skilled in the art, the detailed disclosure is not intended to limit the invention and accordingly, all suitable modifications and equivalents may be resorted to, falling within the scope of the claimed invention.

What I claim is:

1. A plasma display panel including a pair of substrates, comprising:

a mixture of discharge gases contained between the substrates, said mixture consisting of neon gas, xenon gas and krypton gas, a percentage content of said krypton gas being selected in the range of 1 to 14 percent of said mixture, whereby near-infrared rays radiated from said xenon gas during the gas discharge is retarded.

2. A plasma display panel as recited in claim 1, wherein said range of said krypton gas component in said discharge gas is from 6 to 10 percent.

3. A plasma display panel as recited in claim 1, wherein said range of said xenon gas component in said discharge gas is from 2 to 10 percent.

4. A plasma display panel comprising, a pair of substrates opposing each other via a discharge space filled with a discharge gas;

surface discharge electrodes disposed on a first substrate of said pair;

a dielectric layer for covering said electrodes;

a protection layer, having a large secondary electron emission coefficient, for covering said dielectric layer; and a fluorescent material, disposed on a second substrate of said pair, emitting light by being excited by ultra-violet rays emitted from a gas discharge, wherein said discharge gas comprises a three-component gas mixture consisting of neon gas as a majority component, xenon gas selected in a range of from 1 to 14 percent of said mixture.

5. A plasma display panel as recited in claim 4, wherein said range of said krypton gas component in said discharge gas is from 6 to 10 percent.

6. A plasma display panel as recited in claim 4, wherein said protection layer comprises a mixture of compounds of alkaline earth metals.

7. A plasma display panel as recited in claim 6, wherein said alkaline earth metal compound is selected from a group consisting of magnesium oxide, strontium oxide and calcium oxide.

8. A plasma display panel as recited in claim 4, wherein said range of said xenon gas component in said discharge gas is from 2 to 10 percent.

9. A plasma display pane including a pair of substrates and fluorescent materials for being excited by an ultra-violet light emitted from a gas discharge, comprising:

a three-component mixture of discharge gases a contained between said substrates, said three-component mixture consisting of neon gas as a majority component, xenon gas and krypton gas, a percentager content of said krypton gas being selected in a range of 1 to 14 percent of said mixture.

10. A plasma display panel as recited in claim 9, wherein said range of said xenon gas component in said discharge gas is from 2 to 10 percent.

11. A plasma display panel as recited in claim 9, wherein said range of said krypton gas component in said discharge gas is from 6 to 10 percent.

* * * * *

UNITED STATES PATENT AND TRADEMARK OFFICE

CERTIFICATE OF CORRECTION

PATENT NO.: 6,057,643
DATED : May 2, 2000
INVENTOR(S): Teruo KURAI

It is certified that error appears in the above-identified patent and that said Letters Patent is hereby corrected as shown below:

Col. 7, line 6, delete "for:
line 8, delete "for";
line 16, after "gas" insert --and Krypton gas--.

Col. 8, line 11, delete "a";
line 14, change "percentager" to --percentage--.

Signed and Sealed this

Twenty-seventh Day of March, 2001

*Attest:*

*Attesting Officer*

NICHOLAS P. GODICI

*Acting Director of the United States Patent and Trademark Office*